United States Patent [19]

Idei et al.

[11] Patent Number: 4,800,846

[45] Date of Patent: Jan. 31, 1989

[54] METHOD OF CONTROLLING A FLUIDIZED BED BOILER

[75] Inventors: Yasumasa Idei; Satoshi Orisaki, both of Yamaguchi, Japan

[73] Assignee: Ube Industries, Ltd., Ube, Japan

[21] Appl. No.: 203,221

[22] Filed: Jun. 6, 1988

[30] Foreign Application Priority Data

Jun. 23, 1987 [JP] Japan ..... 62-156150

[51] Int. Cl.[4] ..... F23C 11/02

[52] U.S. Cl. ..... 122/4 D; 110/101 CF; 110/245; 110/263; 110/347; 122/449

[58] Field of Search ..... 110/245, 263, 185, 186, 110/187, 188, 189, 190, 345, 346, 347, 101 CF; 122/4 D, 449; 431/7 C; 236/14, 15 R, 5 BD, 15 BB, 15 C, 15 E

[56] References Cited

U.S. PATENT DOCUMENTS

| | | | |
|---|---|---|---|
| 4,278,052 | 7/1981 | Sharp | 122/449 |
| 4,279,207 | 7/1981 | Wormser | 110/345 |
| 4,311,102 | 1/1982 | Kolze et al. | 122/449 X |
| 4,332,207 | 6/1982 | Blaskowski et al. | 122/449 X |
| 4,335,683 | 6/1982 | Criswell et al. | 122/4 D |
| 4,499,857 | 2/1985 | Wormser | 122/4 D |
| 4,574,746 | 3/1986 | Keyes, IV et al. | 236/14 X |
| 4,614,167 | 9/1986 | Bergkvist | 122/4 D |
| 4,768,468 | 9/1988 | Idei | 122/4 D |

*Primary Examiner*—Steven E. Warner

*Attorney, Agent, or Firm*—Frank J. Jordan; C. Bruce Hamburg; Manabu Kanesaka

[57] ABSTRACT

A fluidized bed boiler is controlled such that, when the fuel supply quantity thereof is changed from $F_0$ to $F_1$, the fuel supply quantity is changed to a level greater than the difference between $F_1$ and $F_0$, the fuel supply quantity is changed to a level smaller than the difference between $F_1$ and $F_0$, and the fuel supply quantity is then set to $F_1$.

5 Claims, 5 Drawing Sheets

METHOD OF CONTROLLING A FLUIDIZED BED BOILER

FIELD OF THE INVENTION AND RELATED ART STATEMENT

This invention relates to a method of controlling a fluidized bed boiler which performs fluidizing combustion of coal or the like, and more particularly to such method which is improved so as to minimize changes in the temperature of the fluidized bed even if the load may change.

As well known, a fluidized bed boiler supplies fuel continuously into fluidizing chamber and air through a distributor plate into the fluidizing chamber to combust fuel, fluidize a fluidizing medium, and perform heat exchange in heating tubes disposed within the fluidizing chamber. In this fluidized bed boiler, the installation height of the heating tubes and the quantity of charged fluidized medium are set such that the heating tubes are not immersed in the fluidized bed.

In such boiler, the heating tubes are immersed in the fluidized bed and the boiler is operated in an area in which the overall heat transfer coefficient is not lowered even if the air flow rate is lowered, which is a feature of heat transfer of the fluidized bed. Therefore, even if the fuel supply quantity and air supply quantity are reduced and the combustion heat of fuel is lowered when the boiler load is lowered, the heat transfer coefficient and the heat transfer surface are not substantially lowered. Therefore, the fluidized bed may rapidly lower in temperature and not be able to operate.

In contrast, if the fuel supply quantity and air supply quantity are increased when the boiler load is increased, the temperature of the fluidized bed may rapidly increase to thereby cause a trouble such as a clinkering of the fluidizing medium.

In order to cope with this, U.S. Pat. No. 4,279,207 discloses that when the boiler load increases, the quantity of a fluidizing medium increases, the contact area between the fluidized bed and heating tubes increases to thereby increase a heat quantity transferred from the fluidized bed to the heating tubes. It also discloses discharge of fluidizing medium when the load decreases (especially, column 10, lines 54–62 and column 11, lines 7–14).

U.S. Pat. No. 4,499,857 discloses especially in column 4,lines 53–60 and in column 6, lines 17–19 that the height of the fluidizing medium is controlled in accordance with the temperature of the fluidized bed.

*Mining Engineering,* page 244, right column, lines 12–19 and FIG. 7, published in U.S.A., April 1986, discloses that the height of the fluidized bed and the number of heating tubes immersed in the fluidized bed are changed in accordance with the load.

In U.S. Ser. No. 134,345, filed Dec. 17, 1987, now U.S. Pat. No. 4,768,468, the present applicant proposed the following method of controlling a fluidized bed boiler. This method is used to control the fuel supply quantity and the primary air supply quantity in accordance with a load on the fluidized bed boiler to thereby change the height of the fluidized bed, and to control the number of the heating tubes immersed in the fluidized bed to maintain the temperature of the bed at a constant value, the installation height of the fluidizing medium being controlled by the following process of:

(1) setting a reference range of the installation height of the fluidizing medium and a reference range of the temperature of the fluidized bed within the fluidizing chamber in accordance with the kind of solid fuel supplied to the fluidizing chamber and the pressure within the drum;

(2) sensing the installation height of the fluidizing medium within the fluidizing chamber, comparing the sensed height with the set reference range of the selected bed height, and supplying or discharging the fluidizing medium by the supplying or discharging means for the fluidizing medium so that the settled bed height falls within the reference range of the settled bed height;

(3) sensing the temperature of the fluidized bed within the fluidizing chamber, comparing the sensed temperature of the fluidized bed with the set reference range, re-setting the reference range of the fluidizing medium settled bed height at a higher height in accordance with the temperature difference by which the temperature of the fluidized bed exceeds the reference range, if any, and re-setting the reference range of the fluidizing medium settled bed height at a lower height in accordance with the temperature difference by which the fluidized bed temperature is below the reference temperature range, if any; and returning to the process (2) thereafter.

According to this method, if the quantities of supplied air and fuel are decreased in accordance with, for example, a decrease in the boiler load, the height of the fluidized bed is lowered, so that the number of heating tubes immersed in the fluidized bed is decreased. In contrast, when the quantities of supplied air and fuel are increased in accordance with an increase of the load, the height of the fluidized bed is increased, so that the number of heating tubes immersed in the fluidized bed is increased. Therefore, the area of the heating tubes which the fluidizing medium contacts is changed in accordance with a change in the boiler load. Thus the overall quantity of heat transferred from the fluidized bed to the heating tubes is changed in accordance with a change in the load to thereby greatly reduce fluctuations in the temperature of the fluidized bed. Therefore, even if the boiler load may change, a stabilized operation of the fluidized bed boiler continues.

However, in an examination conducted subsequently, it was verified that the method disclosed in U.S. Ser. No. 134,345 poses the following problem. In other words, when the air quantity is increased and the height of the fluidized bed is raised in correspondence with an increase in the load, the air quantity becomes excessive, which results in a greater quantity of nitrogen oxides ($NO_x$) produced. Conversely, if the air quantity is reduced and the height of the fluidized bed is lowered in correspondence with a decrease in the load, sulfur oxides ($SO_x$) are liable to be produced. In the case of a desulfurization method using limestone, the desulfurization reaction thereof mainly takes place as follows: $CaO+SO_2+\frac{1}{2}—O_2 \rightarrow CaSO_4$. However, if the air quantity is small, the quantity of oxygen ($O_2$) lacks, which makes it difficult for the aforementioned desulfurization reaction to progress.

For this reason, also in the case of the method of controlling a boiler disclosed in U.S. Ser. No. 134,345, the air quantity has to be controlled in correspondence with the combustion of solid fuel, so that the load response characteristics have been poor accordingly.

OBJECT AND SUMMARY OF THE INVENTION

Accordingly, an object of the present invention is to provide a method of controlling a fluidized bed boiler which is capable of performing the output control speedily and reduces the quantities of nitrogen oxides and sulfur oxides produced.

To this end, according to the present invention, there is provided a method of controlling a fluidized bed boiler whereby, at the time of effecting the control of a boiler output by changing a fuel supply quantity from a supply quantity $F_0$ prior to a load fluctuation to a supply quantity $F_1$ before the load fluctuation, a fuel supply quantity is first changed to a level greater than a difference between $F_1$ and $F_0$, and the fuel supply quantity is then changed to a level smaller than the difference between $F_1$ and $F_0$, followed by changing the fuel quantity supply quantity to $F_1$.

For instance, in effecting the control during an increase in the boiler load in accordance with a method of the present invention, fuel is first supplied in excess of a fuel supply quantity $F_1$ corresponding to the load after a change. As a result, the boiler output rises sharply. Subsequently, the fuel is supplied temporarily in a quantity smaller than the aforementioned quantity $F_1$. This makes it possible to prevent an excessive increase in the boiler output. Subsequently, the fuel supply quantity is set to $F_1$, and a boiler output corresponding to the post-change load is thus maintained.

Also, in cases where the boiler load has declined, the fuel supply quantity is first reduced in such a manner as to be lower than the quantity $F_1$, and after it is recovered up to a quantity exceeding the quantity $F_1$, the fuel supply quantity is set to $F_1$. Thus, a sharp reduction in the output can be effected in a similar manner.

In one form of the present invention, it is possible to provide an arrangement in which, when changing the supply quantity from $F_0$ to $F_1$ which is greater than $F_0$, an excessive fuel quantity $S_1$ shown in FIG. 2, i.e., a fuel quantity supplied in excess of $F_1$, becomes greater than a shortage $S_2$, i.e., a fuel shortage which is smaller than $F_1$, by $\Delta S$. This $\Delta S$ is equivalent to a difference between an in-furnace residual solid fuel quantity $C_1$ when the boiler is being operated stably under the condition of the supply quantity $F_1$ on the one hand, and an in-furnance residual solid fuel quantity $C_0$ when the boiler is being operated stably in the supply quantity $F_0$ on the other. In the present invention, an arrangement may be provided such that, when the supply quantity is changed from $F_0$ to $F_1$ which is smaller than $F_0$, a fuel shortage $T_1$ becomes greater than an excessive quantity $T_2$ by the aforementioned quantity $\Delta S$. According to these methods, after the fuel supply quantity is changed from $F_0$ to $F_1$, the fuel can be burnt stably and more quickly under the condition of the fuel supply quantity $F_1$.

In another form of the present invention, the boiler is operated in such a manner that the excessive quantity $S_1$ becomes substantially equivalent to the shortage $S_2$.

In accordance with the present invention, it is possible to very quickly follow load fluctuations of the fluidized bed boiler. In addition, the quantities of nitrogen oxides $NO_x$ and sulfur oxides $SO_x$ produced can be reduced to a small level.

PREFERRED EMBODIMENTS

Figure 1:
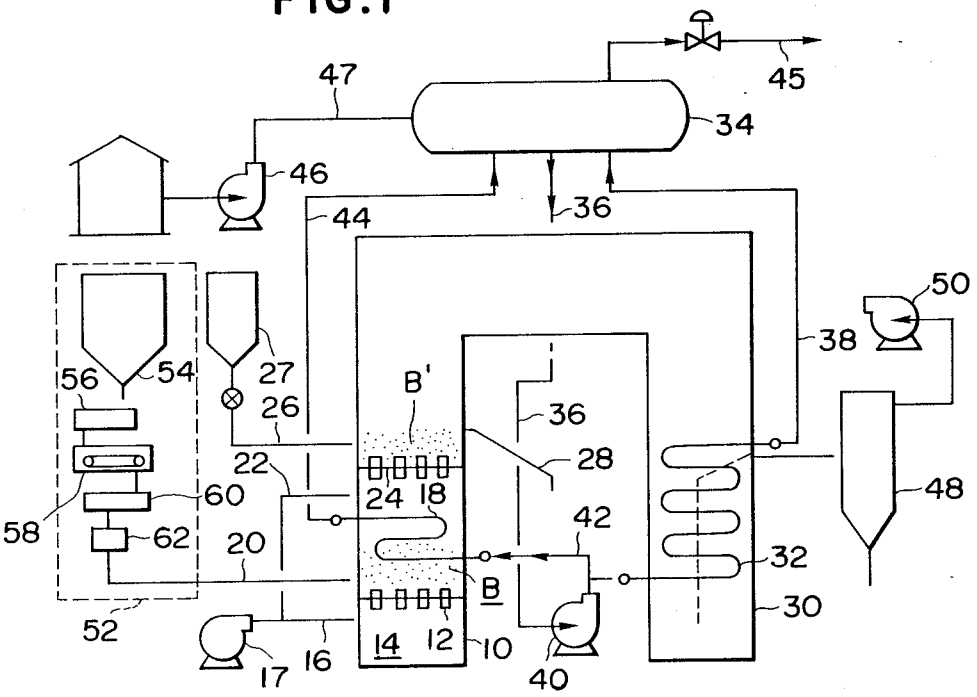
FIG. 1 is a schematic diagram of a fluidized bed boiler system explaining an embodiment of the present invention.
Figure 3:
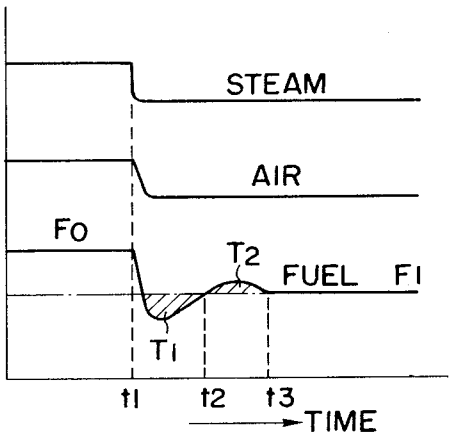
FIGS. 2 and 3 are graphs respectively illustrating examples of control.

Referring now to the accompanying drawings, a description will be given of an embodiment of the present invention.

Reference numeral 10 denotes a boiler furnace, on the inner bottom of which is provided a distribution plate 12 extending across the boiler furnace to form an air chamber 14 to which is coupled a forced draft fan 17 via a primary air supply pipe 16. Provided above the distributor plate 12 is a fluidizing chamber in which are provided a multiplicity of heating tubes 18. In this embodiment, the heating tubes 18 are provided vertically in multiple stages. Reference numeral 20 denotes a plurality of fuel supply tubes (for granular coal in this embodiment) provided immediately above the distributor plate 12 so as to ensure uniform supply of fuel.

A secondary air supply pipe 22 is connected to a free board portion above the heating tubes 18. A distributor plate 24 is provided further above the secondary air supply pipe 22 in such a manner as to transverse the interior of the boiler furnace, and a desulfurization chamber is formed thereabove. Reference numeral 26 denotes a tube for supplying a desulfurizing medium (limestone in this embodiment) such as limestone or dolomite from a bunker 27. Numeral 28 denotes a discharge pipe for discharging the limestone after desulfurization. In addition, numeral 30 denotes a waste heat boiler in which a heating tube 32 is provided. A steam drum 34 is connected to this heating tube 32 via pipes 36, 38. Provided midway in the pipe 36 is a circulating pump 40 whose discharge side is connected via a pump 42 to one end of the heating pipe 18 via a pipe 42, the other end of the heating pipe 18 being connected via a pipe 44 to the steam drum 34. A steam supply pipe 45 is connected to the steam drum 34 which is adapted to receive soft water via a feed water pump 46 and a pipe 47. Reference numeral 48 denotes a baghouse connected to the waste heat boiler 30, and an induced draft fan 50 is provided downstream of the baghouse 48.

A coal feed device 52 includes a coal bunker 54, a horizontal rotary valve 56, a metering conveyor 58, a hammer crusher 60, and a splitter 62. Granular coal is supplied from the supply pipes 20 to the furnance 10 by means of, for instance, pneumatic conveyance.

In the above arrangement, a fluidizing medium is filled into the fluidizing chamber above the distributor plate 12, granular coal supplied from the supply pipes 20 is burn with the aid of the primary air supplied via the air chamber 14 to form a fluidized bed B. The flue gas is then supplied with the secondary air to enter a desulfurizing fluidized bed B' so as to undergo desulfurization. The gas is then subjected to heat exchange in the waste heat boiler 30, the dust of which is collected at the baghouse 48, and then discharged into the atmosphere.

The coal and the air are controlled in response to load fluctuations as follows.

Figure 2:
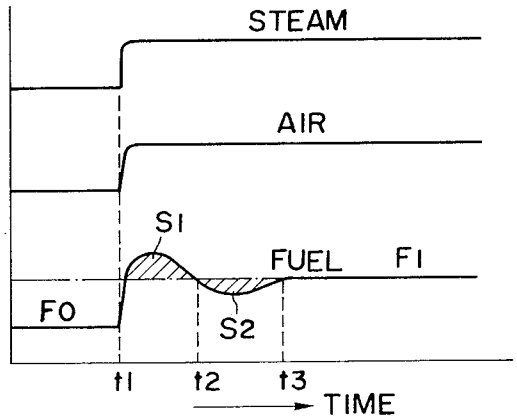

In cases where the load has increased, the quantity of coal is increased to a level greater than the coal supply quantity $F_1$ corresponding to a targeted load, as shown in FIG. 2. Since the burning rate of the granular coal is generally small, an increase in the combustion calorie is slow even if the quantity of coal is increased. In this invention, however, this slow increase in the combustion calorie is compensated by making the increase in the coal quantity excessive. Subsequently, the coal supply quantity is throttled in such a manner as to be lower than the quantity $F_1$ to offset the effect of this excessive supply, and the coal supply quantity is in due time returned to the coal supply quantity $F_1$ corresponding to the increased load. In addition, the air quantity is varied by following an increase in the load. This arrangement makes it possible to sharply increase the boiler output, thereby allowing the same to quickly follow an increase in the load. Furthermore, in the case of the present invention, since the air quantity can be increased or decreased in response to an increase or decrease in the load, fluctuations in the in-furnance $O_2$ concentration are small despite sharp variations in the air quantity. Consequently, the quantity of $NO_x$ produced does not increase, and the desulfurization can be performed stably.

In addition, in cases where the load has declined, the coal supply quantity is decreased excessively to a level which is smaller than the supply quantity $F_1$ corresponding to the targeted load. As a result, the boiler output starts decreasing speedily. Subsequently, after the supply quantity is set to a level exceeding the aforementioned supply quantity $F_1$ to compensate the excessive decrease, the supply quantity is set to the supply quantity $F_1$. As a result, the boiler output is reduced speedily.

In this embodiment, the height of the installed heating tubes 18 and the quantity of fluidizing medium filled are set such that when the height of the fluidized bed B is changed in correspondence to a change in the boiler load, the number of heating tubes 18 immersed in the fluidized bed B is changed. For example, when the boiler load becomes maximum, the quantities of supplied coal and primary air become maximum, so that all the heating tubes 18 are immersed in the bed B. When the boiler load is intermediate, the quantities of supplied coal and primary air are decreased correspondingly, and the height of the bed B is lowered, so that the tubes 18 in the uppermost stage are exposed from the bed B. When the boiler load is minimum, the quantities of coal and primary air are reduced to their minimums, so that the height of the bed B is further lowered. Thus the uppermost- and intermediate-stage heating tubes 18 are exposed from the bed B, and the lowermost-stage tubes 18 alone are embedded in the bed B. In this way, when the height of the bed B is changed in accordance with a change in the boiler load, the number of heating tubes 18 immersed in the bed B is changed to thereby change the heat transfer surface area. Therefore, the total quantity of heat transferred from the bed B to the tubes 18 is changed in accordance with a change in the load, so that more speedy output control becomes possible and fluctuations in the temperature of the bed B are greatly reduced. Thus, even if the boiler load is lowered, a large amount of heat is exchanged to thereby avoid rapid lowering of the bed temperature, thereby ensuring stabilized boiler operation even in a low load condition.

Figure 4:
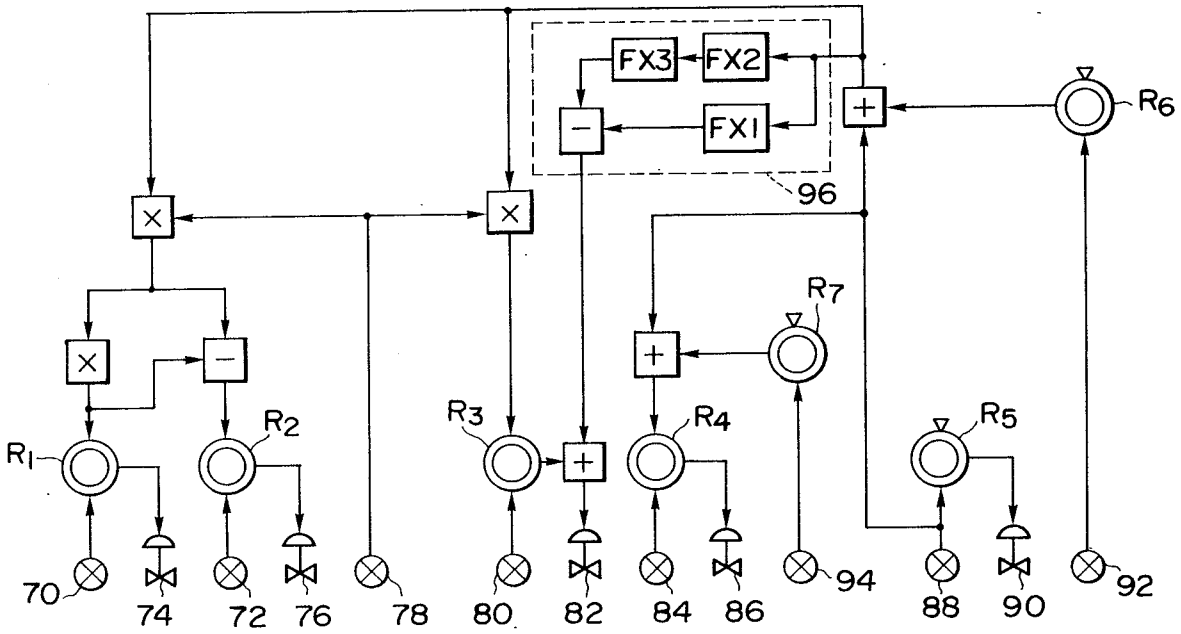
FIG. 4 is a block diagram of a control system.

The instrumentation of the fluidized bed boiler will now be described with reference to FIG. 4 which is a control block diagram.

The primary and secondary air supply pipes 16, 22 are provided with flow meters 70, 72 and flow control valves 74, 76. An oxygen sensor 78 is provided in the furnace 10 for sensing the oxygen content therein. The coal supply pipe 20 is provided with a flow meter 80 and a flow control valve 82, while the water supply tube 47 is provided with a flow meter 84 and a flow control valve 86. The steam supply pipe 45 is provided with a flow meter 88 and a flow control valve 90, and the steam drum 34 is provided with a pressure meter 92 and a water level meter 94.

The signals from the flow meters 70, 72, 80, 84 and 88 are input to controller $R_1$–$R_5$, respectively. The signals from the pressure meter 92 and the water level meter 94 are input to regulators $R_6$ and $R_7$, respectively.

The detection signals representing the steam quantity and the drum pressure as well as the detection signal representing the oxygen level in the furnace are input to the regulator $R_3$, and a coal supply quantity-setting signal is output from the regulator $R_3$ so that the coal supply quantity changes from $F_0$ to $F_1$ in correspondence to the boiler load. Simultaneously, the detection signals representing the steam quantity and the drum pressure are input to a coal supply quantity calculating circuit 96 which in turn calculates a prescribed coal supply quantity change curve corresponding to the boiler load. The output from the circuit 96 is added to the aforementioned coal supply quantity-setting signal to control the valve 82.

The detection signals representing the steam quantity and the drum pressure as well as the detection signals representing the coal quantity and oxygen level in the furnace are input to the regulators $R_1$ and $R_2$ to control the valves 74, 76. In addition, the steam quantity detection signals and the drum level detection signals are input to the regulator $R_4$ to control the valve 86.

Figure 6:
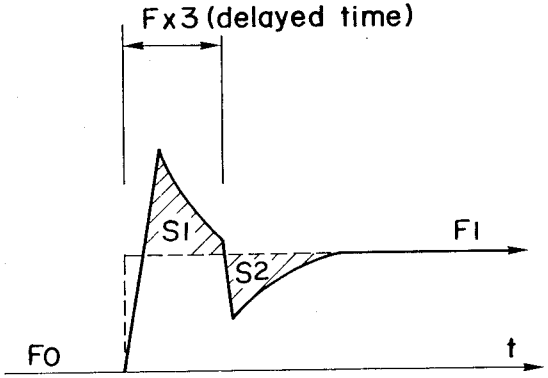
FIG. 6 is a graph illustrating an example of control.

In this fluidized bed boiler, when the coal supply quantity is changed from $F_0$ to $F_i$ which is greater than $F_0$, a coal supply quantity during excessive supply from a time $t_1$ to $t_2$ shown in FIG. 2 is calculated in an advance-delay calculation FX1 and is output thereby. In addition, a coal supply quantity during a short supply from time $t_2$ to $t_3$ is calculated in an advance-delay calculation Fx1–Fx2 and is output thereby. The signal $\Delta S$ representing a difference between $S_1$ and $S_2$ is output With a time lag calculated in a waste time calculation FX3. FIG. 6 is a graph which illustrates an example of a change with time of a fuel supply quantity F which is output in this control system. At this juncture, the values P and Q in the advance-delay calculations FX1 and FX2 as well as the wasteful time can be adjusted in accordance with a difference in coal type or the like. The value P is a variable for changing the height of a peak, while the value Q is a variable for changing the length of the foot of the peak Control can be effected such as to ensure that a stabilized state is obtained speedily by making the difference $\Delta S$ between $S_1$ and $S_2$ equivalent to a difference between the quantity of coal present in the bed when a balance is established with $F_0$ on the one hand, and the quantity of coal present in the bed when a balance is established with $F_1$ on the other.

When the fuel supply quantity is changed from $F_0$ to $F_1$ which is smaller than $F_0$, the quantity of short supply between t1 and t2 and the quantity of surplus supply between t2 and t3 are calculated in FX1 and FX2. The signal ΔS representing a difference between $T_1$ and $T_2$ is output With a time lag calculated in FX3.

Figure 5:
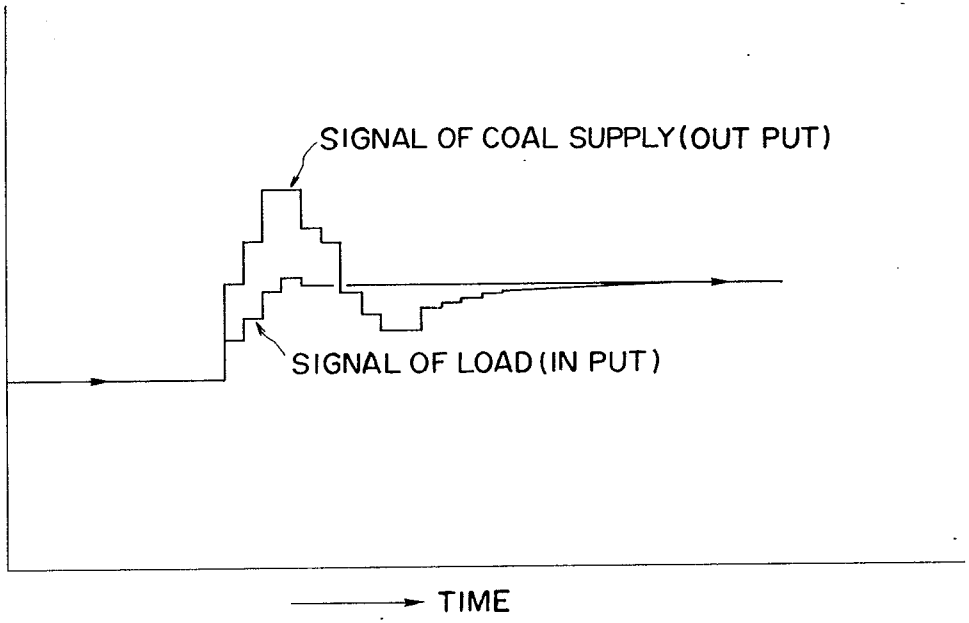
FIG. 5 is a graph illustrating an example of operation of coal quantity control signals by means of a computer.

In such a control system, a calculation of advance and delay expressed by $$\frac{Y(S)}{X(S)} = \frac{PS + 1}{QS + 1}$$

as an operational formula for obtaining a prescribed supply quantity curve of the fuel supply quantity, as well as a calculation of wasteful time were carried out. For instance, FIG. 5 shows an example of the output of a control signal representing the fuel supply quantity using a computer in a case where it is assumed that P=10 and Q=3 in FX1, and that P=7 and Q=3 in FX2. It can be seen from this graph that when a step input signal for increasing the load is input, the supply quantity setting signal increases more than the targeted coal quantity, and decreases from the targeted value, thereby assuming a target. By virtue of such an arrangement, control can be effected in such a manner that the quantity of coal which is actually burnt becomes substantially equivalent to the input signal during an increase in the load.

What is claimed is:

1. A method of controlling a fluidized bed boiler comprising:

an air chamber to which a primary air supply device is connected;

a fluidizing chamber for burning fuel therein and provided above the air chamber, separated by a distributor plate from the air chamber, and supplied with air through the distributor plate;

a plurality of heating tubes provided within the fluidizing chamber and having different installation heights;

a drum connected to the heating tubes for supplying steam by separating steam from water;

means for supplying fuel to the fluidizing chamber;

means for supplying a fluidizing medium to the fluidizing chamber;

means for discharging the fluidizing medium from the fluidizing chamber;

whereby, at the time of effecting the control of a boiler output by changing a fuel supply quantity from a supply quantity $F_0$ prior to a load fluctuation to a supply quantity $F_1$, before said load fluctuation, a fuel supply quantity is first changed to a level greater than a difference between $F_1$ and $F_0$, and the fuel supply quantity is then changed to a level smaller than said difference between $F_1$ and $F_0$, followed by changing the fuel quantity supply quantity to $F_1$.

2. A method of claim 1, wherein control is effected in such a manner that a difference ΔS or ΔT between a surplus $S_1$ or $T_2$ of the fuel supply quantity and a shortage $S_2$ or $T_1$ thereof, i.e., $S_1$–$S_2$ or $T_1$–$T_2$, becomes substantially equivalent to a difference between a quantity of in-furnace residual solid fuel when the fuel supply quantity is $F_0$ and said boiler is operated stably on the one hand, and a quantity of in-furnace residual solid fuel when the fuel supply quantity is F1 and said boiler is operated stably on the other.

3. A method of claim 1, wherein control is effected in such a manner that said surplus $S_1$ or $T_2$ of the fuel supply quantity becomes substantially equal to said shortage $S_2$ or $T_1$.

4. A method of claim 1, wherein the fuel supply quantity and the primary air supply quantity are controlled in accordance with a change in the boiler load to thereby change the number of said heating tubes immersed in said fluidized bed within said fluidizing chamber 5. A method of claim 1, wherein said boiler has a desulfurization bed above said fluidized bed.

* * * * *